US006382531B1

(12) United States Patent
Tracy

(10) Patent No.: US 6,382,531 B1
(45) Date of Patent: May 7, 2002

(54) SHOWER HEAD

(76) Inventor: Martin Tracy, 546 Whitevale Road, Whitevale, Ontario (CA), L0H 1M0

( * ) Notice: Subject to any disclaimer, the term of this patent is extended or adjusted under 35 U.S.C. 154(b) by 0 days.

(21) Appl. No.: 09/788,546

(22) Filed: Feb. 21, 2001

(51) Int. Cl.[7] ..... B05B 1/14; B05B 1/30

(52) U.S. Cl. ..... 239/548; 239/104; 239/106; 239/435; 239/533.1; 239/533.13; 239/546; 239/552; 239/556; 239/567; 239/602; 239/559; 4/615; 401/28

(58) Field of Search ..... 239/104, 106, 239/435, 451, 452, 453, 533.1, 533.13, 533.14, 533.15, 541, 546, 548, 552, 553, 553.3, 553.5, 556, 557, 567, 569, 570, 576, 602, 558, 559, 566; 4/615; 401/28

(56) References Cited

U.S. PATENT DOCUMENTS 757,791 A * 4/1904 Van't woud
816,924 A * 4/1906 Lattin
5,172,862 A * 12/1992 Heimann et al.
5,228,625 A * 7/1993 Grassberger
5,246,301 A * 9/1993 Hirasawa
5,405,089 A * 4/1995 Heimann et al.
5,443,321 A * 8/1995 Dolan et al.
5,730,361 A * 3/1998 Thönnes
6,116,524 A * 9/2000 Zapalac
6,250,572 B1 * 6/2001 Chen

* cited by examiner

*Primary Examiner*—Robin O. Evans
(74) *Attorney, Agent, or Firm*—Merek & Voorhees

(57) ABSTRACT

A shower head generally comprising a backing plate, a diaphragm and a cover plate. The rear surface of the backing plate includes a receptacle for receiving a conduit through which pressurized water may be directed to an aperture extending through the backing plate. The front surface of the diaphragm has a plurality of nipples extending outwardly therefrom with each nipple having longitudinal bore extending therethrough. The cover plate has a plurality of holes extending therethrough for receiving the nipples on the diaphragm such that the cover holds the diaphragm against the front surface of the backing plate. Pressurized water delivered through the aperture causes an outward deflection of the diaphragm away from the backing plate allowing water to be expelled through the bores in the nipples.

15 Claims, 7 Drawing Sheets

SHOWER HEAD

FIELD OF THE INVENTION

This invention relates generally to the field of plumbing accessories, and in particular a new and improved shower head.

BACKGROUND OF THE INVENTION

With showers having become the preferred way of bathing for a substantial percentage of the population, a considerable amount of effort has been expended upon the design of shower heads. Traditionally shower heads were designed primarily from an aesthetic point of view as they were often a prominent visual fixture within a bathroom. However, more recently others have focused their attention upon the design of shower heads that minimize water consumption in order to reduce energy costs. Still others have attempted to create shower heads that have a relatively even spray pattern or, in some instances, provide a pulsating spray having a massaging or relaxing effect.

While a vast array of different shower heads and shower head designs have been contemplated, there nevertheless still exists a need for an aesthetically pleasing and relatively simple shower head design that provides a constant and even spray while minimizing overall water use. There is also the need for a shower head that is essentially "instant off" and that does not continue to drip for an extended period of time after the faucet supplying water to the shower head has been turned off, or where a worn faucet does not completely shut off the supply of water to the shower head.

SUMMARY OF THE INVENTION

The invention therefore provides a mechanically simple, aesthetically pleasing shower head design that provides a constant and soothing spray, and reduces dripping after the supply of water to the shower head has been turned off or in the event that the faucet supplying the shower head will not completely shut off.

Accordingly, in one of its aspects the invention provides a shower head comprising a backing plate having a relatively flat and smooth front surface and a rear surface, said rear surface including a receptacle for receiving a conduit through which pressurized water may be directed, said backing plate further including an aperture passing therethrough permitting water to flow from said receptacle through said aperture to said front surface; a diaphragm receivable over said front surface of said backing plate, said diaphragm having a front and a rear surface, said front surface having a plurality of nipples extending outwardly therefrom, said nipples having longitudinal bores extending therethrough connecting said front and rear surfaces of said diaphragm; and, a cover plate releasably securable to said backing plate, said cover plate having a plurality of holes extending therethrough for receiving said nipples on said diaphragm, when said diaphragm received over said front surface of said backing plate said cover plate releasably securable to said backing plate holding said diaphragm against said front surface of said backing plate with said nipples extending through said holes in said cover plate such that the delivery of pressurized water through said aperture in said backing plate causes an outward deflection of said diaphragm away from said backing plate, said pressurized water flowing between said backing plate and said diaphragm and expelled through said longitudinal bores in said nipples.

In a further aspect the invention provides an improved shower head comprising a backing plate having a relatively flat and smooth front surface and a rear surface that includes a receptacle for receiving a conduit through which pressurized water may be delivered, said backing plate further including an aperture passing from said receptacle to said front surface; a diaphragm having a perimeter dimensioned so as to be receivable over said front surface of said backing plate, said diaphragm having a front surface that includes a plurality of nipples extending outwardly therefrom, each of said nipples having longitudinal bores extending therethrough connecting said front surface of said diaphragm with said rear surface of said diaphragm; and, a cover plate releasably securable to said backing plate, said cover plate having a plurality of holes extending therethrough and arranged in a pattern to match the pattern of said nipples extending outwardly from said front surface of said diaphragm such that when said diaphragm is received over said front surface of said backing plate with said cover plate releasably secured to said backing plate and said diaphragm received and held between said cover plate and said front surface of said backing plate said nipples extending through said holes in said cover plate, upon the delivery of pressurized water through said aperture in said backing plate said diaphragm deflecting outwardly from said backing plate to permit water to flow between said backing plate and said diaphragm to said nipples, where the supply of pressurized water through said aperture is reduced below a predetermined level said diaphragm flexing backwardly from its deflected position and into contact with said front surface of said backing plate thereby stopping the flow of water through said nipples.

Further aspects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

Figure 1:
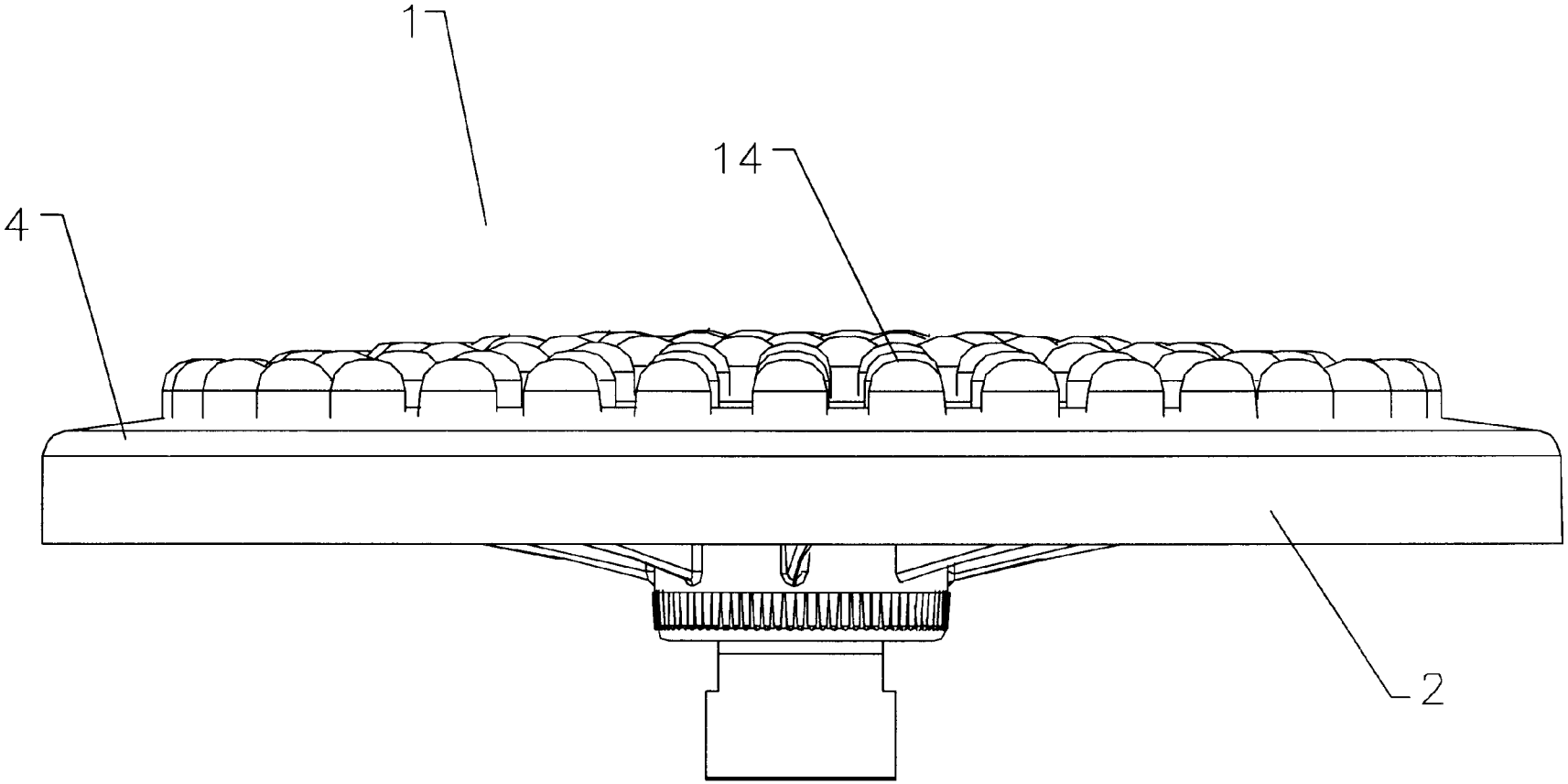
FIG. 1 is a side elevational view of a shower head according to a preferred embodiment of the present invention.
Figure 2:
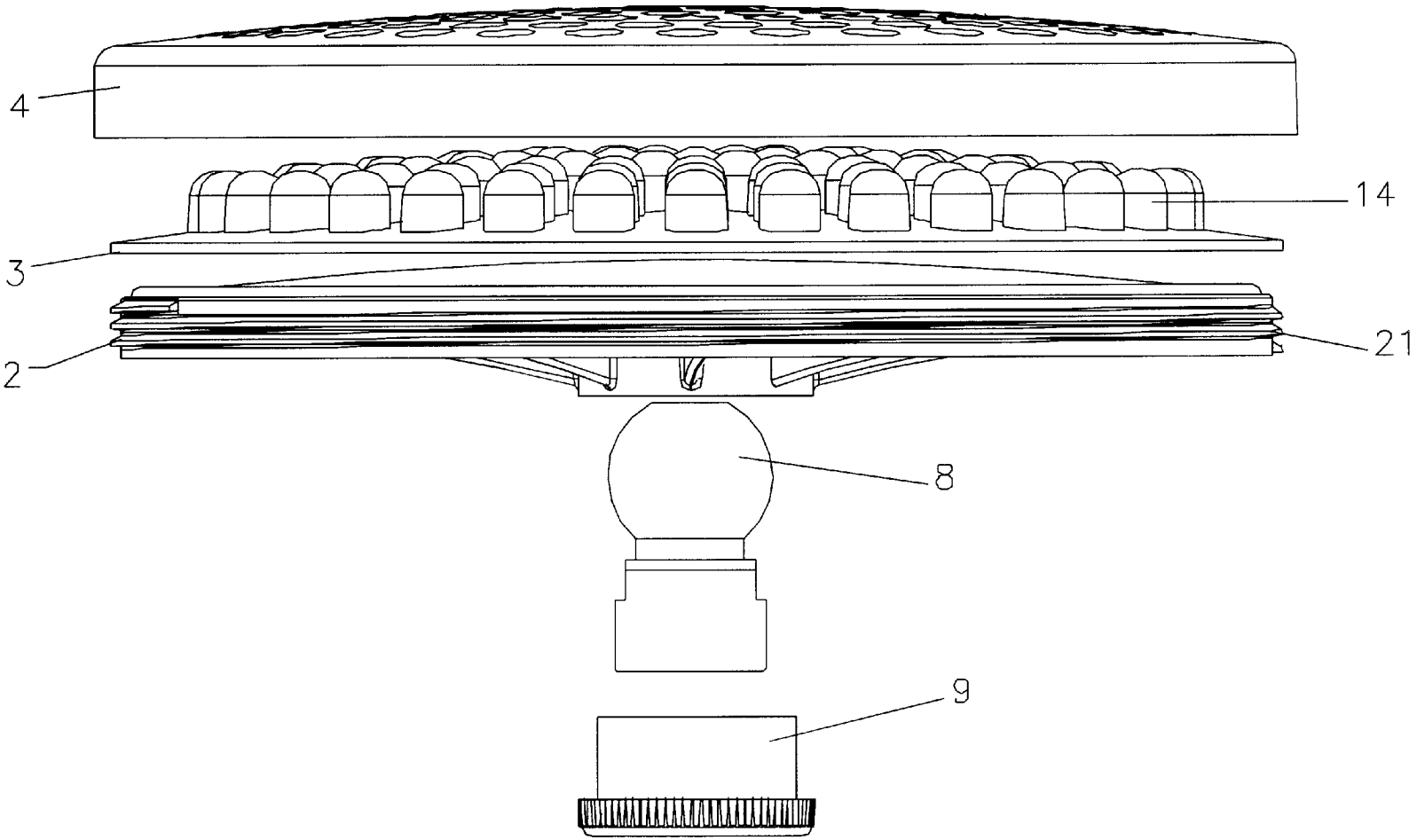
FIG. 2 is an exploded assembly view of the shower head shown in FIG. 1.
Figure 3:
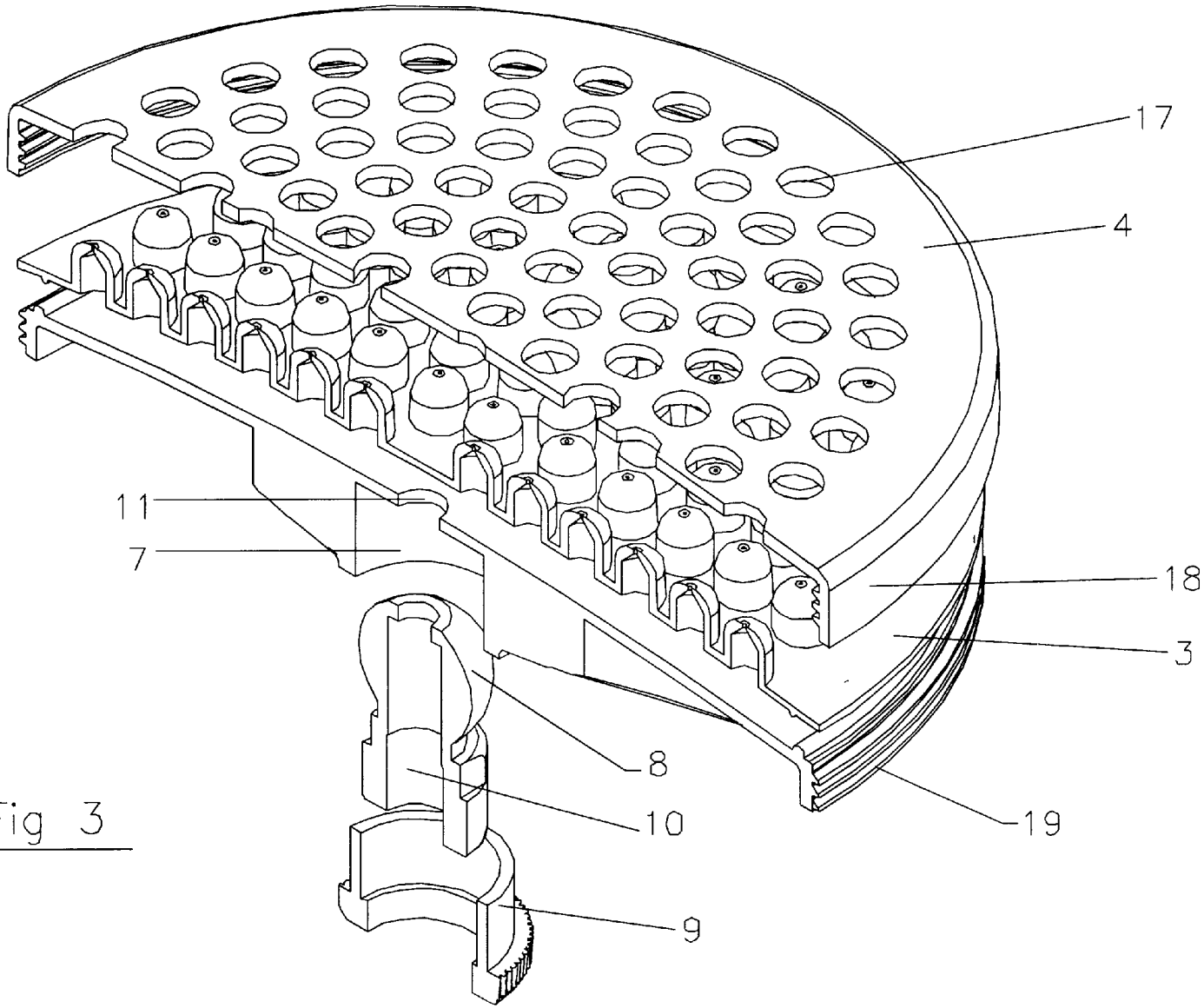
FIG. 3 is an upper side perspective view, in longitudinal section, showing a preferred embodiment of the present invention.
Figure 5:
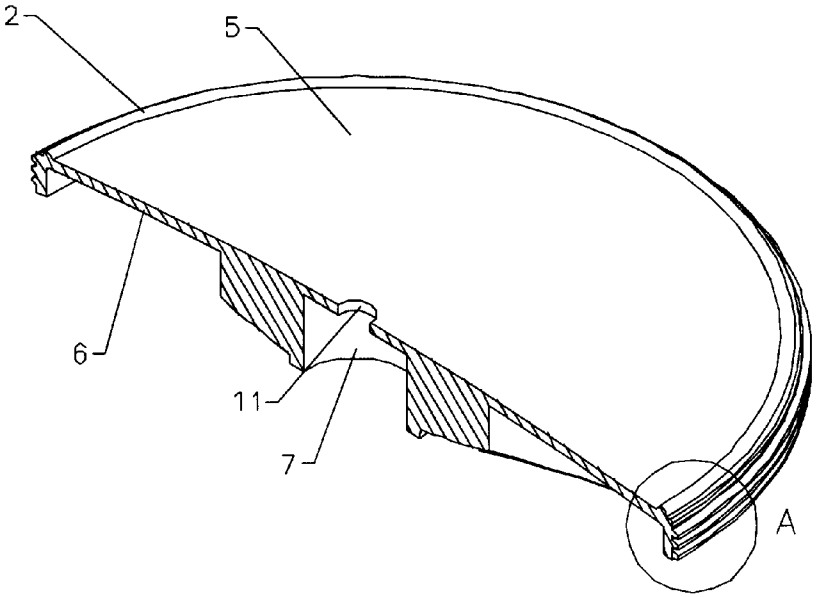
FIG. 5 is an upper side perspective view, in longitudinal section, of the backing plate shown in FIG. 4.
Figure 6:
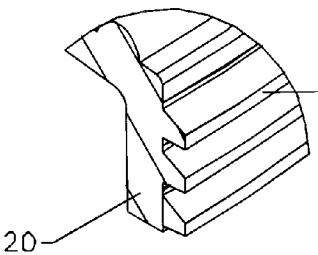
FIG. 6 is a detail view of area "A" shown in FIG. 5.
Figure 4:
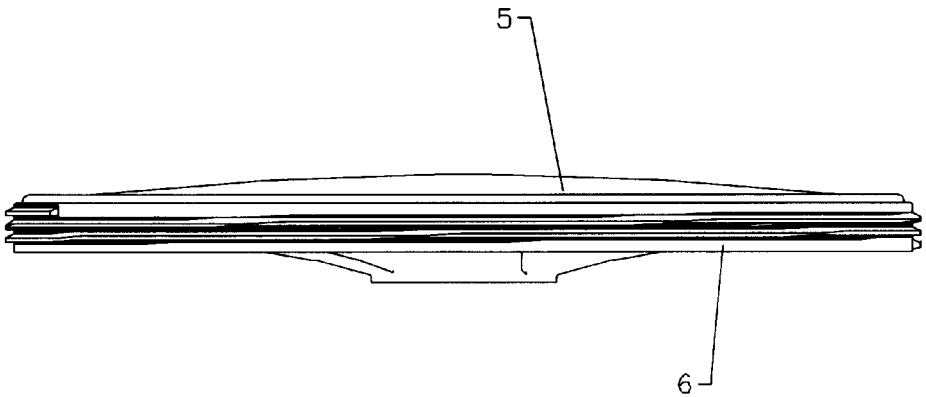
FIG. 4 is a side elevational view of the backing plate of the shower head shown in FIG. 1.
Figure 7:
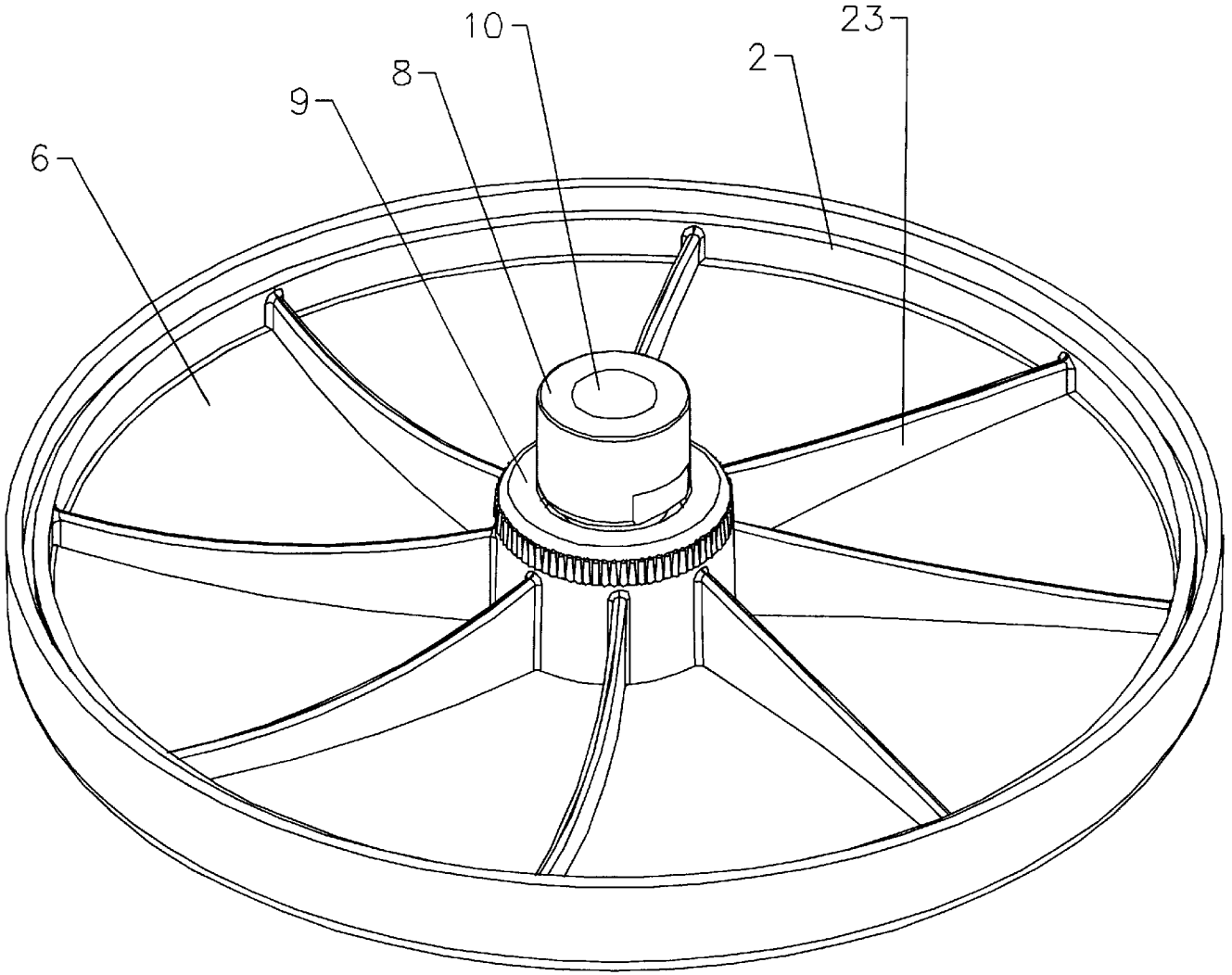
FIG. 7 is a bottom side perspective view of the backing plate shown in FIG. 4.
Figure 10:
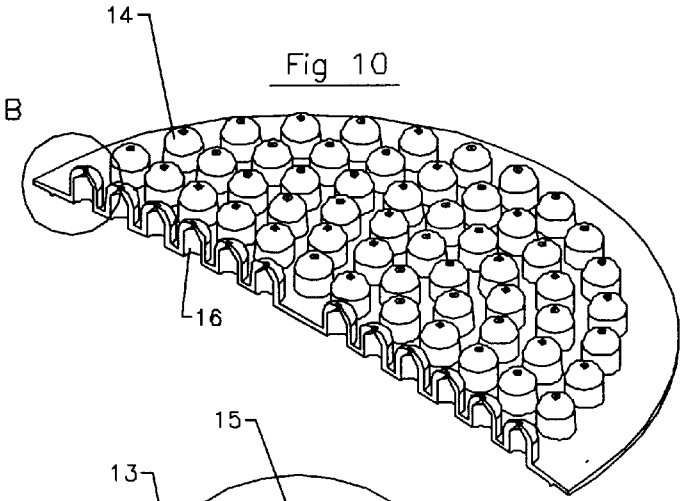
FIG. 10 is an upper side perspective view of the sectional view shown in FIG. 9.
Figure 11:
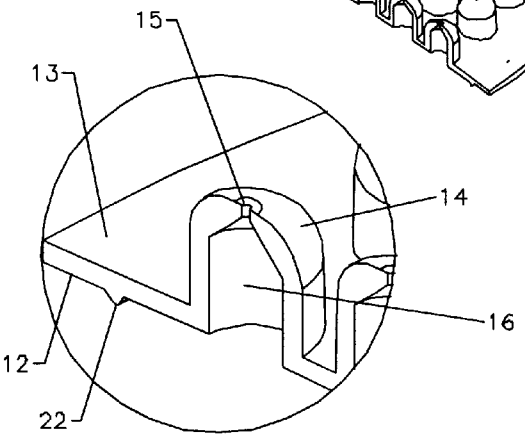
FIG. 11 is a detail view of area "B" shown in FIG. 10.
Figure 8:
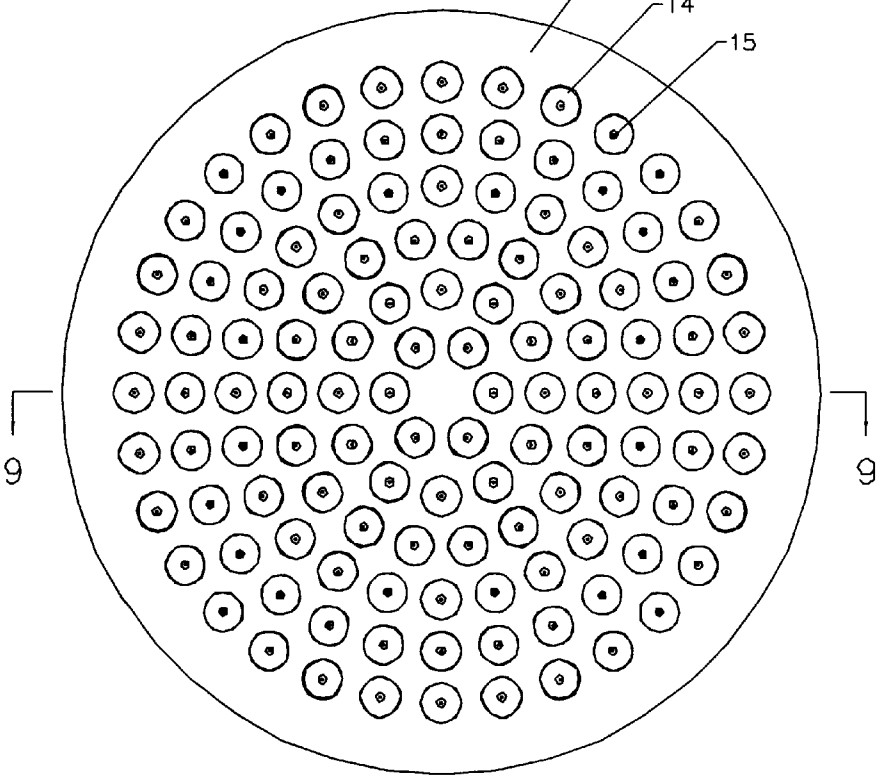
FIG. 8 is a top plan view of the diaphragm of the shower head shown in FIG. 1.
Figure 9:
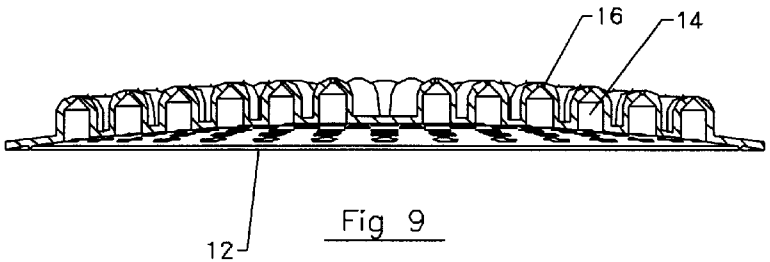
FIG. 9 is a sectional view taken along the line 9—9 of FIG. 8.
Figure 14:
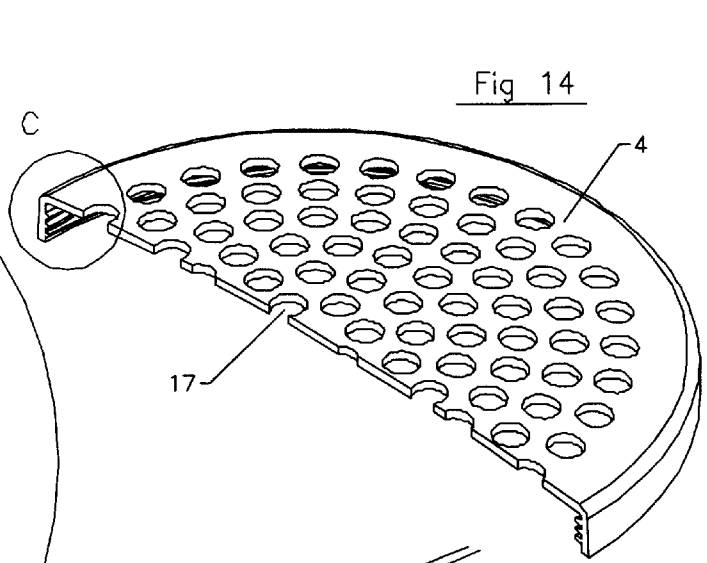
FIG. 14 is an upper side perspective view, in longitudinal section, of the cover plate shown in FIG. 13; and, FIG. 15 is a detail view of area "C" shown in FIG. 14.
Figure 15:
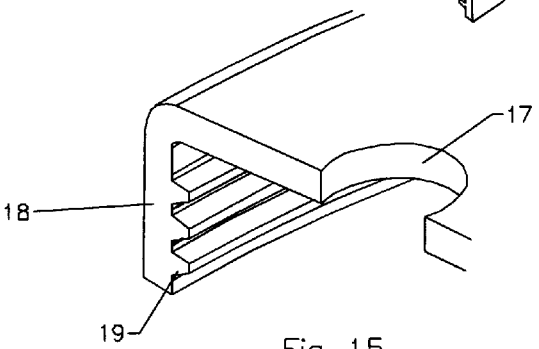
Figure 13:
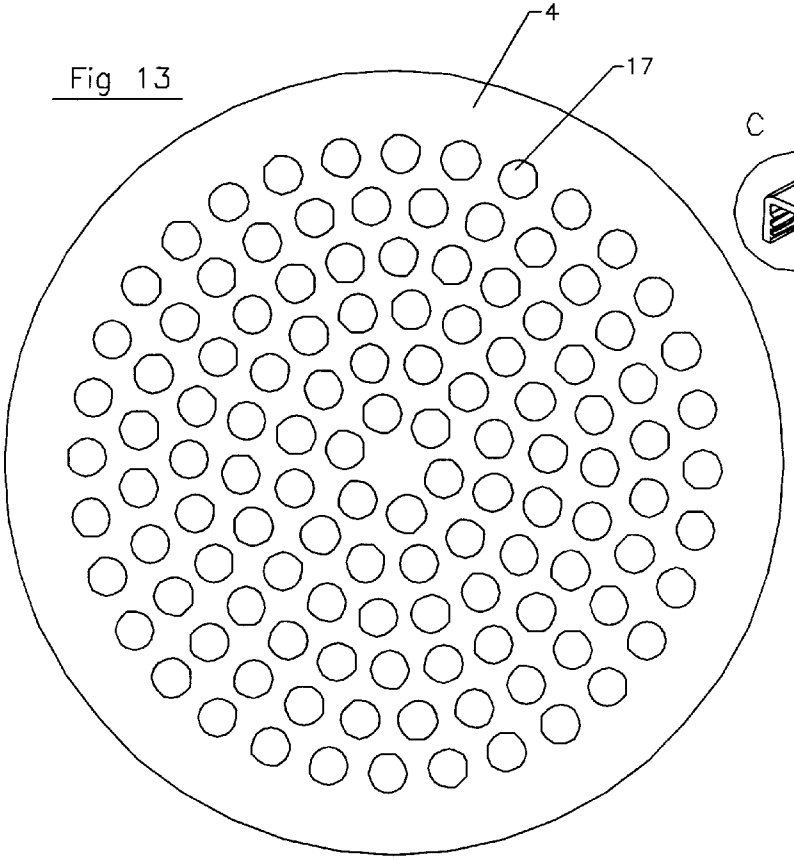
FIG. 13 is a plan view of the cover plate shown in FIG. 12.
Figure 12:
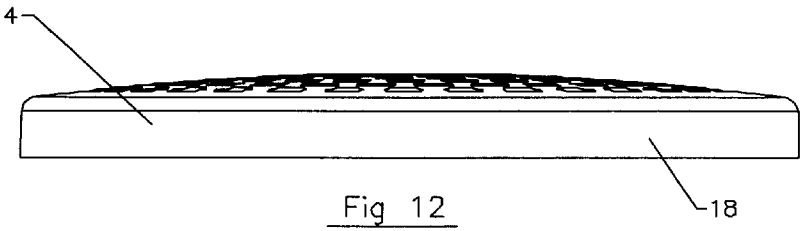
FIG. 12 is a side elevational view of the cover plate of the shower head shown in FIG. 1.

The present invention may be embodied in a number of different forms. However, the specification and drawings that follow describe and disclose only some of the specific forms of the invention and are not intended to limit the scope of the invention as defined in the claims that follow herein.

The shower head according to the present invention is shown in the attached drawings and noted generally by reference numeral 1. Shower head 1 is comprised of three primary components; namely, a backing plate 2, a diaphragm 3, and a cover plate 4. The structure and function of backing plate 2 is perhaps best understood through an examination of FIGS. 2 through 7. In a preferred embodiment of the invention backing plate 2 has a relatively flat and smooth front service 5, and a rear surface 6. In the embodiment of the invention shown in the attached drawings, backing plate 2, and for that matter diaphragm 3, cover plate 4 and shower head 1, are generally circular in shape to present an aesthetically pleasing product having an overall appearance consistent with that of traditional shower heads. However, the shower head and its primary component parts could be configured in a wide variety of other geometric shapes while staying within the broad scope of the invention.

As shown in the attached drawings, backing plate 2 includes a receptacle 7 that is positioned generally in the center of rear surface 6. Receptacle 7 is configured so as to receive a conduit through which pressurized water may be directed. In one embodiment, receptacle 7 may contain internal threads to permit backing plate 2 to be screwed directly upon a water supply line in a shower or tub enclosure. In an alternate embodiment, and as shown specifically in FIGS. 1 through 3, receptacle 7 may be in the form of a socket that receives a ball adapter 8 that is releasably secured within the receptacle by means of a locking nut 9. Locking nut 9 would typically have a series of internal threads to allow it to be threadably received upon a water supply line in a shower or tub enclosure. Through the utilization of ball adapter 8 there is provided a mechanism by which the orientation of shower head 1 can be easily altered through the orbital movement of the ball adapter within receptacle 7. A longitudinal bore through ball adapter 8 provides a mean for water to be delivered from a supply line to receptacle 7. An aperture 11, passing through backing plate 2 and located generally in the central portion of receptacle 7, permits pressurized water to flow from the receptacle through to front surface 5 of the backing plate.

The design and configuration of shower head 1 is such that backing plate 2, diaphragm 3, and cover plate 4 may be secured together in a "sandwich" type structure with the diaphragm releasably secured between the backing and cover plates. The physical size and configuration of diaphragm 3 is therefore such that it can be received against front surface 5 of backing plate 2 and thereafter held in place through releasably securing cover plate 4 to backing plate 2.

The particular configuration and structure of diaphragm 3 is detailed in FIGS. 8 through 11. As shown, diaphragm 3 has a rear surface 12 and a front surface 13. The front surface contains a plurality of nipples 14 extending outwardly therefrom. Each nipple has a longitudinal bore 15 extending therethrough that connects the front and rear surfaces of the diaphragm, and that allows pressurized water to pass through the nipple. In the embodiment shown in the attached drawings, bores 15 are enlarged where they intersect rear surface 12 of diaphragm 3. The areas of enlargement form a chamber 16 in the base of each nipple.

Chambers 16 serve a number of different functions. First, they act as small balancing chambers that provide a space for pressurized water to accumulate prior to being forced out through front surface 13 of diaphragm 3. Secondly, they provide an increased area within which hard water deposits may accumulate without blocking individual bores extending through particular nipples. That is, it will be appreciated that a single small diameter bore extending longitudinally through the entire nipple will have a tendency to become clogged by hard water deposits more quickly than in the case where the rear portion of the bore has been enlarged to create chamber 16. Finally, chambers 16 will serve to both reduce the amount of material required in the formation of diaphragm 3, and will also help to increase the flexibility of individual nipples.

In a preferred embodiment of the invention diaphragm 3 is comprised of latex, rubber, silicone or a similar flexible resilient material. The existence of chambers 16 within the base of each nipple enhances their flexibility and provides a mechanism by which hard water deposits can, to a large extent, be freed from the nipples by manually pushing upon individual nipples and deflecting them from their normal orientation. Deflecting and deforming the nipples in this fashion tends to break brittle hard water deposits into small pieces that are then readily shed from the nipples. Chambers 16 enhance the ability for such deflection and the removal of hardened and solidified deposits upon the nipples. The resiliency of the material from which the diaphragm is made returns the nipples to their original configuration when the deflecting force is removed.

As shown in FIGS. 12 through 15, cover plate 4 is comprised of a relatively thin plate having a plurality of holes 17 extending therethrough for receiving nipples 14 of diaphragm 3. In order for the cover plate to be received over the diaphragm, holes 17 are geometrically arranged in the same pattern as the nipples on diaphragm 3. Holes 17 may be of a slightly larger diameter than the outside diameter of nipples 14 to enable the nipples to be easily inserted therethrough.

As indicated, cover plate 4 is releasably securable to backing plate 2 in order that diaphragm 3 may be securely held between the cover and backing plates. In the embodiment shown in the attached drawings, the securement of cover plate 4 to backing plate 3 is accomplished through threadably engaging the cover plate with the backing plate. To this extent cover plate 4 contains a downwardly directed circumferential flange 18 having threads 19 on its interior surface. Similarly, backing plate 2 is configured with a circumferential flange 20 having threads 21 on its exterior surface. Through proper dimensioning of flanges 18 and 20 cover plate 4 may thus be threaded onto backing plate 2. Accordingly, assembly of shower head 1 merely requires the positioning of diaphragm 3 against cover plate 4 such that nipples 14 extend through holes 17, after which the cover plate may be threadably secured to backing plate 2 with diaphragm 3 held securely against front surface 5 of the backing plate. It will, of course, be appreciated that cover plate 4 could also be releasably secured to backing plate 2 through the use of a wide variety of other fastening mechanisms, including screws, bolts, rivets, spring clips, friction fasteners, adhesives, and other fastening devices.

Where diaphragm 3 is comprised of a flexible, resilient material, the supply of pressurized water through aperture 11 in backing plate 2 will cause a slight outward deflection of the diaphragm away from front surface 5 of the backing plate. Backing plate 2 and cover plate 4 are dimensioned so that when fastened together with the diaphragm received between them the rear surface of the diaphragm is generally held within close proximity or against the front surface of the backing plate while still permitting a slight deflection of the diaphragm when it's rear surface is pressurized. This slight deflection provides a thin space between the backing plate and the diaphragm that forms a water filled pressurized chamber. This water filled chamber provides a supply of water at a generally constant pressure to bores 15 in nipples 14. The generally constant pressure of the water supplied to the nipples, in conjunction with the flexible nature of the diaphragm, helps to ensure a consistent pressurized spray from the nipples.

To help enhance the flexure of the diaphragm, in one embodiment of the invention diaphragm 3, cover plate 4, and front surface 5 of backing plate 2 are slightly convex in shape. The flexibility and resiliency of diaphragm 3 are such that when the supply of pressurized water through aperture 11 is reduced below a predetermined level (or shut off completely) the diaphragm flexes backwardly toward the backing plate until rear surface 12 of the diaphragm is once again in contact with front surface 5 of backing plate 2.

Preferably the peripheral edges of cover plate 4, diaphragm 3 and backing plate 2 are sealed such that there is no leakage of water around the outer edges of the backing plate. Any one of wide variety of different sealing mechanisms could be utilized to prevent such leakage. In the particular embodiment shown in the attached drawings, the rear surface 12 of diaphragm 3 contains an integrated circumferential rib 22 that is compressed against front surface 5 of backing plate 2 when the cover plate is secured to the backing plate. This compression of rib 22 against the backing plate serves to prevent water from seeping from between the backing plate and the diaphragm, and leaking from between flanges 18 and 20.

When shower head 1 is assembled with diaphragm 3 positioned over front surface 5 of backing plate 2, there are preferably no nipples in the diaphragm immediately adjacent aperture 11. That is, the portion of diaphragm 3 adjacent front surface 5 of backing plate 2 about aperture 11 is relatively smooth and flat. In one embodiment of the invention, when water pressure is reduced or removed from the shower head the diaphragm is allowed to flex backwardly and into contact with the front surface of the backing plate such that the smooth flat portion of the diaphragm adjacent to aperture 11 will effectively operate as a seal to help prevent the flow of water through the aperture. In this embodiment, only when there is sufficient water pressure within aperture 11 to cause diaphragm 4 to slightly deflect away from the backing plate will the seal be broken and water allowed to flow between the backing plate and the diaphragm. In alternate embodiments of the invention a seal may be included on either the backing plate or integrally within the diaphragm to help stop the flow through aperture 11.

It will thus be appreciated that the described structure will essentially provide an "instant off" shower head that minimizes dripping once the supply of water has been shut off.

In addition, in the event that valve supplying water to the shower head is not turned completely off, or if the valve is worn and will not close completely, the above described structure will effectively prevent a constant dripping of the shower head and the associated wasteful use of water and energy. The absence of nipples upon that portion of diaphragm 3 immediately adjacent aperture 11 also helps to prevent direct impingement of water that flows through the aperture upon one or more nipples, and an uneven distribution of the flow through bores 15 in adjacent nipples.

In order to present a pleasing spray of water from shower head 1, preferably longitudinal bores 15 through nipples 14 are arranged in a relatively parallel configuration such that jets of pressurized water that are expelled through the bores travel in a generally parallel path upon exiting the nipples. Where diaphragm 3 is formed in a slightly convex fashion maintaining longitudinal bores 15 such that they are generally parallel across the face of the diaphragm, will require the nipples to intersect the surface of the diaphragm at angles of inclination that increase as one moves from the center of the diaphragm to its periphery. Where nipples 14 are arranged in a generally circular pattern on the diaphragm (as shown in the attached drawing) the resulting water stream from shower head 1 will be in the form of a relatively tight cylinder. Bores 15 are also preferably of a small diameter (for example approximately 0.025 inches) to form a fine jet of water that tends to maintain a consistent path of travel as it exits the shower head. Such fine, tightly configured, spray patterns have been found to be generally refreshing and stimulating to the skin. The small diameter of bores 15 also presents a means to establish back pressure in the water filled chamber between the diaphragm and the backing plate. This back pressure helps to ensure a relatively even distribution of flow to the nipples and a more even discharge from the shower head.

The structure of the above invention will provide a shower head that is capable of providing a stream of small, fine individual jets of water at a relatively constant pressure that are maintained in a generally cylindrical configuration. The shower head is of a simplified construction that allows for inexpensive fabrication and assembly. In many instances the backing plate, diaphragm, and cover plate may be molded from synthetic materials. As indicated, diaphragm 3 is preferably comprised of latex, rubber or silicon such that it is both flexible and resilient. The backing plate and cover plate may be formed from a variety of materials including a number of different plastics or metallic alloys. Where backing plate 2 is formed from a plastic material, or of a relatively thin metallic alloy, rear surface 6 of the backing plate may include stiffening members 23 to assist in preventing flexure of the backing plate in a rearward direction upon the delivery of pressurized water between its front surface and the diaphragm. In addition, where backing plate 2 and cover plate 4 are comprised of metallic alloys or other relatively rigid materials that do not readily lend themselves to permitting outward deflection of the diaphragm, the front surface of the backing plate may include a plurality of flow channels across its surface to assist in the delivery of water to nipples 14.

Finally, and as also discussed above, regardless of the material from which shower head 1 is comprised, the described structure provides a mechanism to positively seal the flow of water through the shower head when the water pressure drops below a particular value. This feature assists in the prevention of dripping and also prevents the wasteful use of water and energy in the event that the valve supplying water to the shower head is unintentionally left partially open or is worn such that it cannot be completely closed.

It is to be understood that what has been described are the preferred embodiments of the invention and that it may be possible to make variations to these embodiments while staying within the broad scope of the invention. Some of these variations have been discussed while others will be readily apparent to those skilled in the art.

I claim:

1. A shower head comprising:

(i) a backing plate having a relatively flat and smooth front surface and a rear surface, said rear surface including a receptacle for receiving a conduit through which pressurized water may be directed, said backing plate further including an aperture passing therethrough permitting water to flow from said receptacle through said aperture to said front surface;

(ii) a diaphragm receivable over said front surface of said backing plate, said diaphragm having a front and a rear surface, said front surface having a plurality of nipples extending outwardly therefrom, said nipples having longitudinal bores extending therethrough connecting said front and rear surfaces of said diaphragm; and, (iii) a cover plate releasably securable to said backing plate, said cover plate having a plurality of holes extending therethrough for receiving said nipples on said diaphragm, when said diaphragm received over said front surface of said backing plate said cover plate releasably securable to said backing plate holding said diaphragm against said front surface of said backing plate with said nipples extending through said holes in said cover plate such that the delivery of pressurized water through said aperture in said backing plate causes an outward deflection of said diaphragm away from said backing plate, said pressurized water flowing between said backing plate and said diaphragm and expelled through said longitudinal bores in said nipples.

2. The device as claimed in claim 1 wherein said diaphragm is comprised of a flexible, resilient material such that when the supply of pressurized water through said aperture is reduced below a predetermined value said diaphragm flexes backwardly from its deflected position and into contact with said front surface of said backing plate thereby stopping the flow of water through said nipples.

3. The device as claimed in claim 1 wherein said diaphragm, when in contact with said front surface of said backing plate, generally preventing the flow of water through said aperture and to said bores extending through said nipples.

4. The device as claimed in claim 1 wherein said outward deflection of said diaphragm by said pressurized water results in the formation of a water filled pressurized chamber between said backing plate and said diaphragm, said water filled chamber providing a supply of water at a generally constant pressure to said longitudinal bores in said nipples.

5. The device as claimed in claim 4 wherein said backing plate, said diaphragm, and said cover plate are slightly convex in shape.

6. The device as claimed in claim 5 wherein said longitudinal bores through said nipples are arranged in a generally parallel configuration such that jets of pressurized water expelled through said bores travel in a generally parallel path upon exiting said nipples.

7. The device as claimed in claim 6 wherein said longitudinal bores through said nipples have an enlarged diameter portion at their point of intersection with said rear surface of said diaphragm, said enlarged diameter portions forming water chambers within said nipples.

8. The device as claimed in claim 7 wherein said cover plate is threadably receivable on said backing plate.

9. The device as claimed in claim 8 having a seal between the peripheral edges of said cover plate, said diaphragm and said backing plate to prevent the leakage of water therethrough.

10. The device as claimed in claim 9 wherein said diaphragm is formed from latex, rubber, or silicone.

11. The device as claimed in claim 1 wherein said rear surface of said backing plate includes stiffening members to assist in preventing flexure of said backing plate upon the delivery of pressurized water between said front surface of said backing plate and said diaphragm.

12. An improved shower head comprising (i) a backing plate having a relatively flat and smooth front surface and a rear surface that includes a receptacle for receiving a conduit through which pressurized water may be delivered, said backing plate further including an aperture passing from said receptacle to said front surface;

(ii) a diaphragm having a perimeter dimensioned so as to be receivable over said front surface of said backing plate, said diaphragm having a front surface that includes a plurality of nipples extending outwardly therefrom, each of said nipples having longitudinal bores extending therethrough connecting said front surface of said diaphragm with said rear surface of said diaphragm; and, (iii) a cover plate releasably securable to said backing plate, said cover plate having a plurality of holes extending therethrough and arranged in a pattern to match the pattern of said nipples extending outwardly from said front surface of said diaphragm such that when said diaphragm is received over said front surface of said backing plate with said cover plate releasably secured to said backing plate and said diaphragm received and held between said cover plate and said front surface of said backing plate said nipples extending through said holes in said cover plate, upon the delivery of pressurized water through said aperture in said backing plate said diaphragm deflecting outwardly from said backing plate to permit water to flow between said backing plate and said diaphragm to said nipples, where the supply of pressurized water through said aperture is reduced below a predetermined level said diaphragm flexing backwardly from its deflected position and into contact with said front surface of said backing plate thereby stopping the flow of water through said nipples.

13. The device as claimed in claim 12 wherein said backing plate, said diaphragm and said cover are slightly convex in shape with said longitudinal bores through said nipples arranged in a generally parallel configuration such that pressurized water expelled through said bores travels in a generally parallel path upon exiting said nipples.

14. The device as claimed in claim 12 including a seal between said diaphragm and said front surface of said backing plate, said seal assisting in stopping the flow of water through said nipples when the supply of pressurized water is reduced below said predetermined level.

15. The device as claimed in claim 14 wherein said seal is formed integrally with said diaphragm.

* * * * *